United States Patent [19]

Berges

[11] 4,014,458

[45] Mar. 29, 1977

[54] THREE-FUNCTION CONTAINER

[75] Inventor: Timothy J. Berges, Mansfield, Ohio

[73] Assignee: Sanchez Enterprises, Inc., Mansfield, Ohio

[22] Filed: Mar. 19, 1976

[21] Appl. No.: 668,694

[52] U.S. Cl. ..... 220/335; 220/1.5; 220/334

[51] Int. Cl.[2] ..... B65D 43/24

[58] Field of Search ..... 220/1.5, 4, 6, 334, 220/335, 343

[56] References Cited

UNITED STATES PATENTS 3,270,902 9/1966 Breault ..... 220/334 X 3,392,870 7/1968 Schulz ..... 220/334 X

*Primary Examiner*—George T. Hall

[57] ABSTRACT

A material handling container for use in storing parts in a factory having two hinged doors on one side, each pivotal about a centrally located horizontal axis. By rotating the doors to various raised and lowered positions, the container may be placed in any of three configurations, whereby it serves as a material hopper, a parts dispenser, or a laterally closed material storage bin.

3 Claims, 7 Drawing Figures

FIG. 1
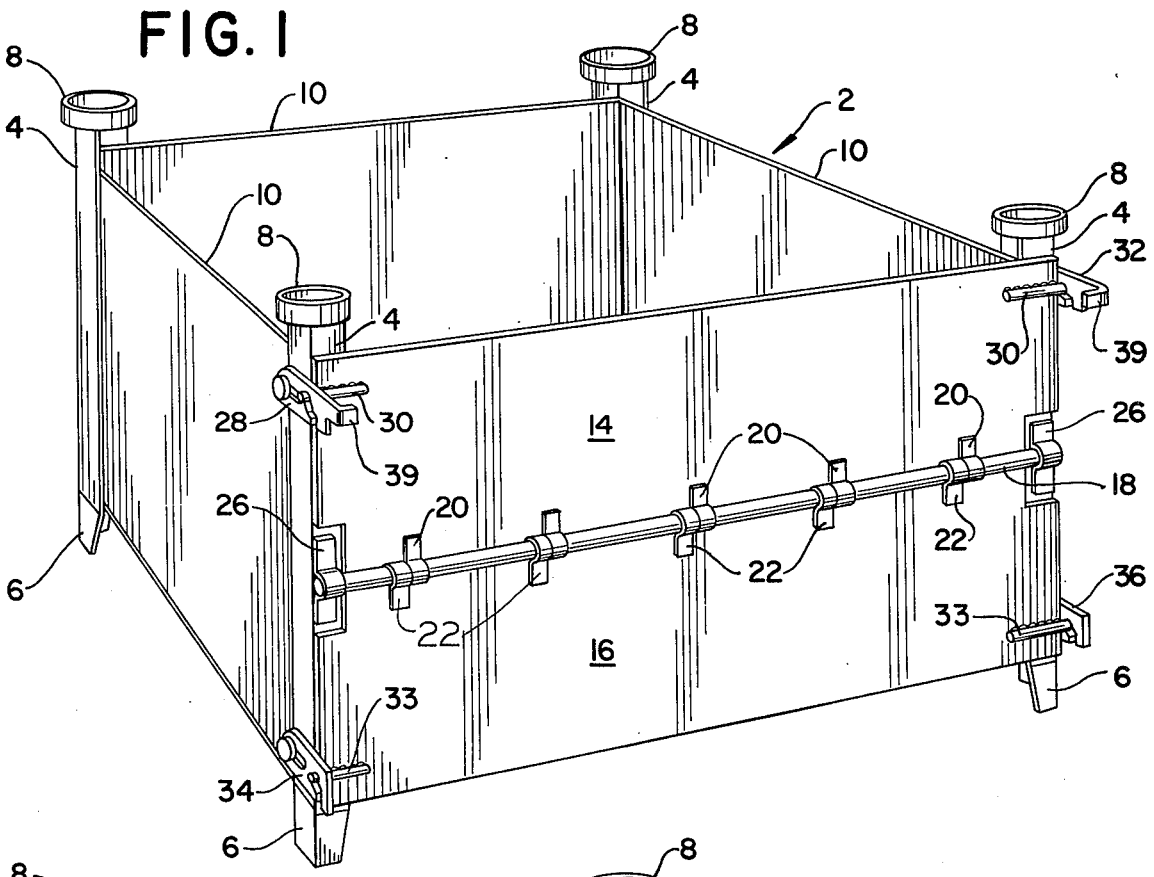
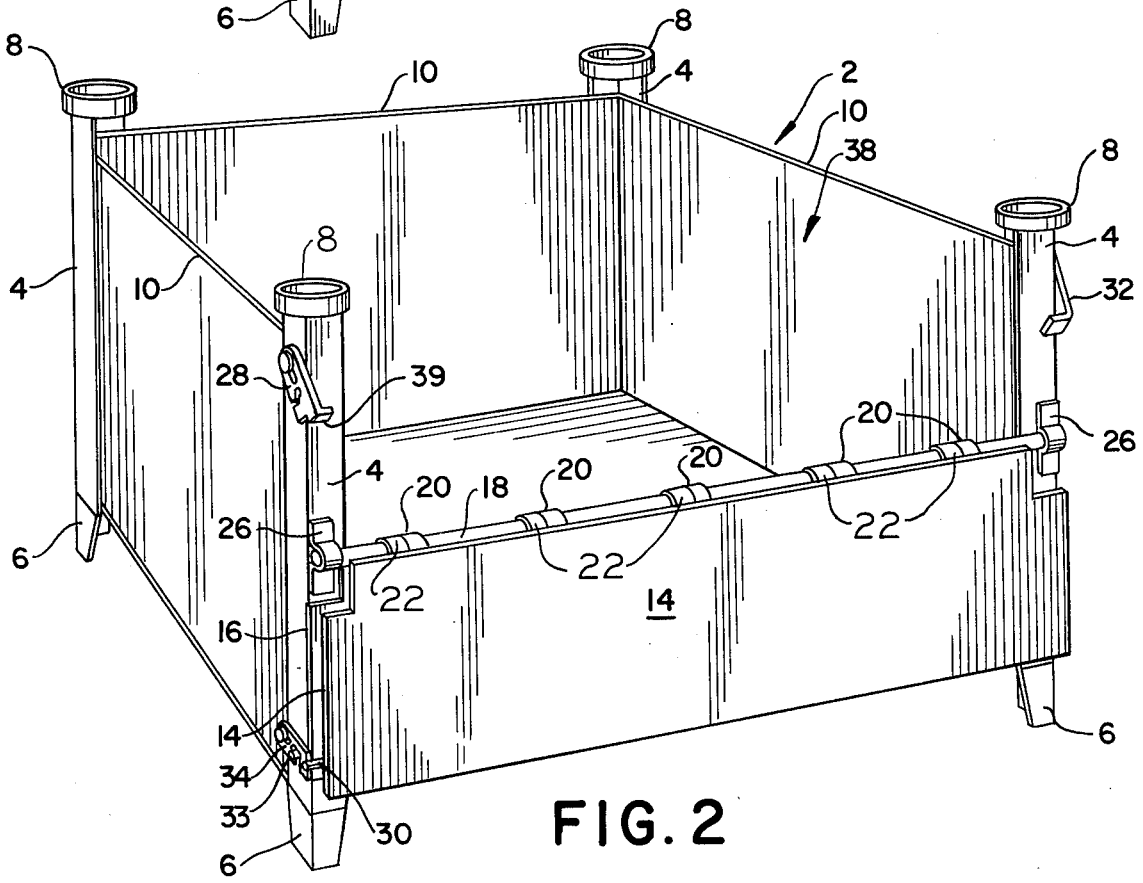
FIG. 2

FIG. 3
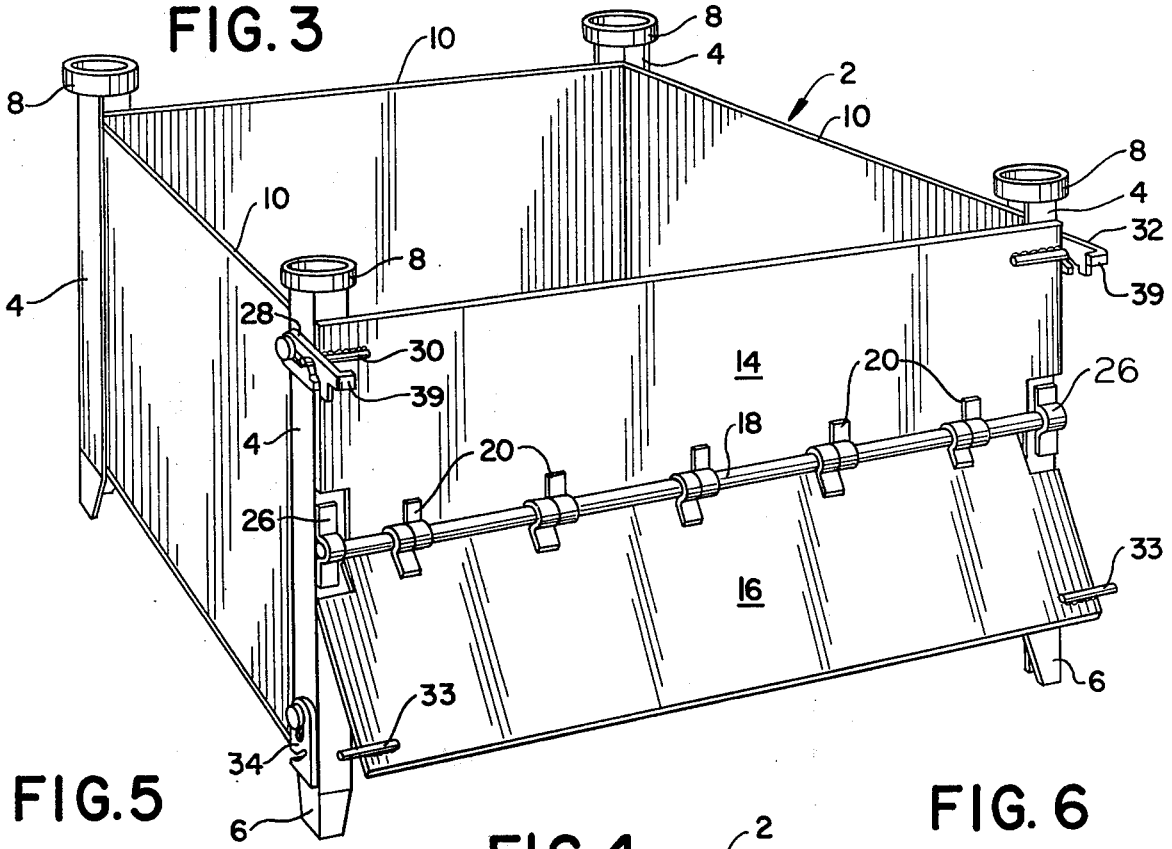
FIG. 5
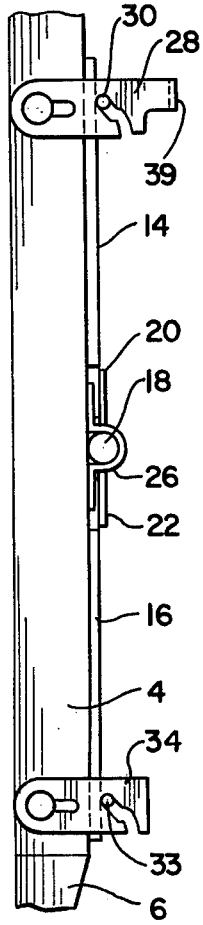
FIG. 4
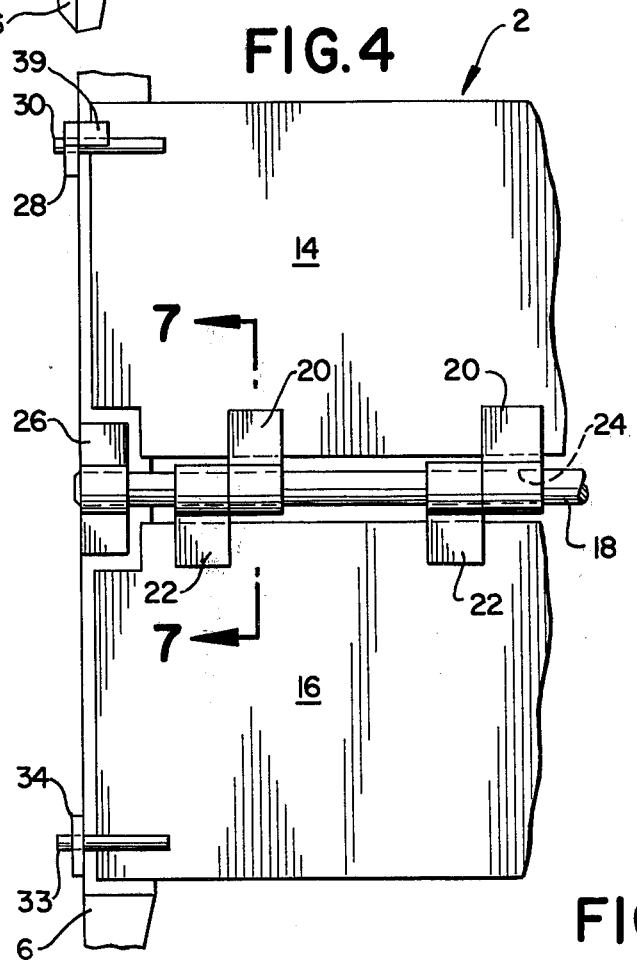
FIG. 6
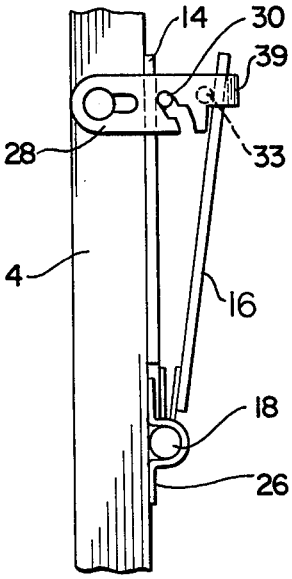
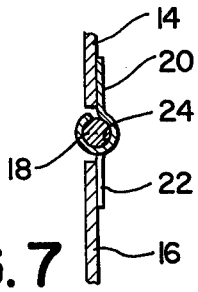
FIG. 7

THREE-FUNCTION CONTAINER

This invention relates to a material handling container or a pallet of the type used in a factory for storing parts that have been partially processed and are awaiting further machining or other process operations.

Different kinds of material handling containers are often needed in a factory, depending on the various situations in which they are used. For instance, if a stack of containers is being used for receiving and storing parts coming from a processing operation, there is no way of loading such containers from the top, because their top openings are blocked by other containers that have been stacked above them. Thus, a laterally opening, hopper-type of container is needed so that parts can be tossed into the container from the side. However, when parts are being taken from a container for further processing work, it is often desirable that the container is capable of being opened at or near its bottom so that it serves as a gravity feed parts dispenser. Then again, there are other situations in which it is best that the container have four solid side walls with no openings, so that the parts will not likely fall out of the container. This last type of container is particularly desirable when the container is being moved in order to transfer the parts from one work station to another.

The problem is that it is hard to predict when a single material handling container might be needed to serve any of the three functions described above. Previous material handling containers which have been designed to serve only one or two of these functions are inadequate or inefficient in operations requiring a container of the third type. For example, the closed-top container of the type shown in U.S. Pat. No. 3,405,835 to C. M. Eby has a hinged door on the upper part of one side which enables the container to function as a hopper with a lateral opening into which parts may be tossed. However, this same container would be cumbersome to use when one desired to remove the parts for further processing. A person would have to reach into the container through the lateral opening and pull out the parts either one by one, or in small handfuls.

In the past, it has been necessary either to "get by" with a material handling container that was inadequate in some of the operations in which it was used, or to provide several kinds of material handling containers to fill the various material storage and material dispensing needs of an industrial facility. The latter solution to the problem is hardly better than the first, since it requires additional costly material handling operations transferring parts between containers, and it also increases costs by increasing the number of containers required by any particular plant operation.

A single container constructed according to my invention fills the need for a container that will perform all three functions required in the processing and transferring of parts between various work stations in a plant. The container has a side wall formed of two hinged doors which are mounted in such a manner that by rotating the doors between various positions, the container may be transformed between configurations in which it serves as a closed walled material storage pallet, a parts receiving hopper, or a gravity feed parts dispenser.

My invention should not be confused with the many material handling containers that have walls that are hinged for the purpose of enabling them to be easily collapsed or disassembled. Examples of such containers are found in U.S. Pat. No. 2,914,210 to Pastor; U.S. Pat. No. 3,093,259 to Morrison; and U.S. Pat. No. 2,919,045 to Waugh et al., as well as the Eby patent mentioned above. These containers might, because of their hinged members, appear to be adaptable to serve more functions than are disclosed in their respective patents. However, the hinged side walls of all these containers must be held in rigid fixed positions except when the container itself is being disassembled. Any attempt to rotate any of these hinged members at other times would result in either the weakening of or the undesired collapse of the container.

Also, my container differs from containers having hinged covers, such as that of U.S. Pat. No. 3,769,970 to Lutz. The hinged parts of my container are on at least one of the side walls, and are securely held to the adjacent walls of the container in each of their various positions.

For a more complete understanding of the nature and objects of my invention, reference should be made to the detailed description of a preferred embodiment of my invention and the attached drawings in which:

FIG. 1 is a perspective view of a material handling container fixed in a first configuration and illustrating one embodiment of my invention;

FIG. 2 is a perspective view of the material handling container of FIG. 1 fixed in a second configuration;

FIG. 3 is a perspective view of the material handling container of FIG. 1 fixed in a third configuration;

FIG. 4 is an enlarged partial front view of the material handling container of FIG. 1;

FIG. 5 is an enlarged partial side view of the material handling container of FIG. 1;

FIG. 6 is an enlarged partial side view of a material handling container fixed in the second configuration of FIG. 2; and FIG. 7 is an enlarged partial side view of a hinge of the material handling container of FIGS. 1 through 6.

As shown in FIG. 1, the invention comprises a material handling container 2 with four closed sides forming a material storage bin.

The container 2 is formed by four vertical corner posts 4 each having a foot member 6 welded to its bottom end and a nesting cup 8 welded to its top. The nesting cups 8 are designed for holding the foot members of a similar container that may be placed on top of the container 2. Between the corner posts 4 on three sides of the container 2, there is a container wall structure formed by three conventional side walls 10. In addition, the container 2 has a bottom section, not shown, which is connected between the bottom portions of the walls 10 and is elevated above the bottoms of the foot members 6.

The foregoing structure of the container 2 is conventional. My invention is directed to the structure on the fourth side of the container 2, where an upper door 14 and a lower door 16 are each rotatably mounted on a single hinge rod 18. As seen most clearly in the enlarged views of FIGS. 4 and 5, there are hinge members 20 fixed to the upper door 14 and hinge members 22 fixed to the lower door 16. The hinge rod 18 slides through tubular openings 24 in all the hinge members (FIG. 7) and is secured by brackets 26 to the upwardly extending side edge portions of the container wall structure, which in this embodiment are formed by two of the corner posts 4.

As shown in FIG. 1, the upper door 14 is held in its upper position by at least one upper latch arm 28, attached to the side of one of the posts 4 adjacent the top portion of the upper door 14. The latch arm 28 may be of any suitable kind, such as the one shown in my co-pending U.S. patent application, entitled "Latch".

As shown in FIGS. 1, 4 and 5, a pin 30 extends from the side of the upper door 14, and the latch arm 28 hooks over the pin 30 to secure the upper door 14 in its raised position adjacent the upper portions of the container posts 4. Preferably, the upper door 14 is made further secure in its raised position by a latch arm 32, identical to the latch arm 28 and located on the opposite side of the upper door 14.

The lower door 16 is secured in its lowered position of FIG. 1 by at least one latch arm 34 attached to the side of one of the posts 4 adjacent the bottom portion of the lower door 16. The latch arm 34 is preferably of the same kind as the latch arms 28 and 32 for the upper door 14, and latches onto a pin 33. Also, the latch arm 34 may be assisted in its function of securing the lower door 16 by another arm latch 36 on the opposite side of the door 16.

With the upper and lower doors 14 and 16 latched in their respective raised and lowered positions shown in FIG. 1, the container 2 forms a four-sided material storage bin with no lateral openings. In this configuration, the container 2 is suitable for all plant operations in which the main object is to retain material in the container, such as when the material is being transported from one work station to another.

FIG. 2 shows the container 2 with the upper door 14 released from its latch arms 28 and 32 and rotated about the hinge rod 18 to a lowered position in which it is either tilted outwardly at an angle to the vertical position, or is hung adjacent to and outwardly disposed from the lower door 16, as shown in FIG. 2. In this position of the doors, the container 2 has an upper lateral opening 38 and forms a hopper into which material or parts may be laterally conveyed or tossed. The container 2 is thus suitable for receiving material or parts from a work station, particularly when other containers are stacked on top of the container 2 so that access to the container 2 from the top is impossible.

FIGS. 3 and 6 show the container 2 with the lower door 16 released from its latch arms 34 and 36 and rotated about the hinge rod 18 to a raised position so as to form the container 2 into a gravity-feed material dispenser. The upper door 14 remains secured by its latch arms 28 and 32 as in FIG. 1. The lower door 16 is either swung outwardly at an angle to the vertical, or is rotated all the way up to a position adjacent to and outwardly disposed from the upper door 14, as shown in FIG. 6. For the purpose of holding the upper door 14 in the raised position of FIG. 6, the latch arms 28 and 32 which secure the upper door 14 may be provided with flanges 38, which extend substantially parallel to the axes about which the latch arms pivot. The flanges 38 are positioned to wrap around the edges of the lower door 16 to hold it in its raised position.

Thus, in the configuration shown in FIGS. 3 and 6, the container 2 serves as a parts dispenser, suitable for use in delivering parts or material to a work station for processing.

It will thus be seen that the material handling container 2 is capable of serving in any one of three configurations, in which it can function respectively as a closed walled bin or pallet, a material receiving hopper, or a gravity-feed parts dispenser. While the foregoing illustrates one embodiment of my invention, modifications may, of course, be made without departing from the spirit of my invention, or the scope of the appended claims.

I claim:

1. A three-function material handling container comprising, a bottom section, a wall structure extending upwardly from said bottom section and including extending side edge portions and a lateral opening therebetween, upper and lower doors extending across said lateral opening in said wall structure, hinge means for each door disposed on an axis substantially parallel to said bottom section, each of said hinge means pivotally connecting its associated door to said upwardly extending side edge portions of said wall structure at a level intermediate said bottom section and the top of said wall structure, a first latch means engageable between said lower door and at least one of said side edge portions beneath said hinge means so as to hold said lower door in a lowered position and said upper door being rotatable about said hinge means to a lowered position so as to leave an upper lateral opening in said container and enable said container to function as a hopper into which material may be laterally conveyed, a second latch means engageable between said upper door and at least one of said side edge portions above said hinge means so as to hold said upper door in a raised position so that said upper and lower doors held in their respective raised and lowered positions form with said wall structure a laterally closed material storage box, and said first latch means being detachable from its engagement between said lower door and said side edge portion so that said lower door is rotatable upwardly and outwardly about said hinge means so as to leave a lower opening in said container and enable said container to function as a gravity-feed material dispenser.

2. The material handling container as set forth in claim 1 wherein each of said latch means includes an arm pivotally mounted about an axis substantially parallel to the axis of said hinge means on one of said upwardly extending side edge portions of said wall structure, a pin extending laterally from a side edge of one of said doors, and a hook means on said arm for engagement with said pin so as to hold said door in a fixed position against said side edge portion of said wall structure.

3. The material handling container as set forth in claim 2 wherein said pivotally mounted arm of said second latch means for holding said upper door has a flange extending substantially parallel to the axis about which said arm is pivoted, said flange being engageable with said lower door when rotated about said hinge means to a raised position adjacent said upper door, whereby both of said doors are held in raised positions by said second latch means when said container is functioning as a gravity-feed material dispenser.

* * * * *